US011739933B2

(12) United States Patent
Cowan et al.

(10) Patent No.: US 11,739,933 B2
(45) Date of Patent: Aug. 29, 2023

(54) OVEN BROILER GAS BURNER FOR COOKING APPLIANCE WITH VARIABLE ELECTROMECHANICAL VALVE

(71) Applicant: Midea Group Co., Ltd., Foshan (CN)

(72) Inventors: Richard W. Cowan, Louisville, KY (US); Cameron James Wyatt, Memphis, TN (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/038,649

(22) Filed: Sep. 30, 2020

(65) Prior Publication Data

US 2022/0099294 A1 Mar. 31, 2022

(51) Int. Cl.
*F23N 1/00* (2006.01)

(52) U.S. Cl.
CPC ..... *F23N 1/005* (2013.01); *F23N 2227/02* (2020.01); *F23N 2235/24* (2020.01); *F23N 2241/08* (2020.01)

(58) Field of Classification Search
None
See application file for complete search history.

(56) References Cited

U.S. PATENT DOCUMENTS

| | | | | |
|---|---|---|---|---|
| 2,781,780 A | | 2/1957 | Zahradka | |
| 2,820,130 A | | 1/1958 | Dadson | |
| 2,931,575 A | | 4/1960 | Reeves et al. | |
| 3,259,121 A | | 7/1966 | McGee | |
| 3,423,020 A | | 1/1969 | Michaels | |
| 3,504,660 A | | 4/1970 | Mcarthur, Jr. et al. | |
| 4,087,231 A | | 5/1978 | Matthews | |
| 4,240,397 A | * | 12/1980 | Seidel | F24C 3/128 126/285 B |
| 4,615,282 A | | 10/1986 | Brown | |
| 4,628,897 A | * | 12/1986 | Stanfa | A47J 37/06 126/41 R |
| 4,899,724 A | | 2/1990 | Kuechler | |
| 5,027,789 A | | 7/1991 | Lynch | |
| 5,560,349 A | | 10/1996 | Lucero | |
| 5,611,327 A | | 3/1997 | Filho et al. | |

(Continued)

FOREIGN PATENT DOCUMENTS

| | | |
|---|---|---|
| EP | 0225655 B1 | 2/1992 |
| EP | 1522790 A2 | 4/2005 |

(Continued)

OTHER PUBLICATIONS

"Difference Between Broiling and Baking" by Koshal, available at https://www.differencebetween.com/difference-between-broiling-and-vs-baking/(Year: 2011).*

(Continued)

*Primary Examiner* — Jason Lau
(74) *Attorney, Agent, or Firm* — Gray Ice Higdon

(57) ABSTRACT

A cooking appliance and method of operating the same utilize a variable electromechanical valve to regulate an output power level of an oven broiler gas burner for a cooking appliance. Among other benefits, in some instances broiler control during cooking may be decoupled from oven warm-up, and in some instances support may be provided for automatic and/or user controlled broiler output power levels and/or automated broil profiles.

19 Claims, 8 Drawing Sheets

(56) References Cited

U.S. PATENT DOCUMENTS

| | | | | |
|---|---|---|---|---|
| 5,662,465 | A | 9/1997 | Kano | |
| 6,216,683 | B1 | 4/2001 | Maughan et al. | |
| 6,419,478 | B1 | 7/2002 | Kemp | |
| 6,619,613 | B1 | 9/2003 | Akamatsu et al. | |
| 7,255,100 | B2 | 8/2007 | Repper et al. | |
| 7,908,847 | B2 | 3/2011 | Crawley et al. | |
| 8,353,281 | B2 | 1/2013 | Oberhomburg et al. | |
| 8,413,646 | B2 | 4/2013 | Wiker et al. | |
| 8,469,019 | B2 | 6/2013 | Barritt et al. | |
| 8,721,325 | B2 | 5/2014 | Geiger et al. | |
| 8,776,776 | B2 | 7/2014 | Todd et al. | |
| 9,546,790 | B2 | 1/2017 | Cadima et al. | |
| 9,645,585 | B2 | 5/2017 | Nguyen et al. | |
| 9,791,152 | B2 | 10/2017 | Jones et al. | |
| 9,841,191 | B2 | 12/2017 | Johncock et al. | |
| 10,036,555 | B2 | 7/2018 | Cadima et al. | |
| 10,077,899 | B2 | 9/2018 | Karkow et al. | |
| 10,203,117 | B2 | 2/2019 | Moon et al. | |
| 10,561,277 | B1 | 2/2020 | Swayne et al. | |
| 10,591,161 | B2 | 3/2020 | Super et al. | |
| 10,739,010 | B2 | 8/2020 | Bassetti et al. | |
| 2006/0213496 | A1 | 9/2006 | Kimble et al. | |
| 2007/0278319 | A1 * | 12/2007 | Jenkins | G05D 23/19 126/273 R |
| 2011/0108017 | A1 * | 5/2011 | Todd | F24C 3/128 126/39 R |
| 2019/0226678 | A1 | 7/2019 | Huang et al. | |
| 2022/0099295 | A1 | 3/2022 | Cowan et al. | |

FOREIGN PATENT DOCUMENTS

| | | | | |
|---|---|---|---|---|
| EP | 2348255 | A2 | 7/2011 | |
| EP | 2116771 | B1 | 8/2011 | |
| JP | 200745929 | A | 2/2007 | |
| WO | WO-2017218695 | A1 * | 12/2017 | A21B 1/33 |
| WO | 2020237281 | A1 | 12/2020 | |

OTHER PUBLICATIONS

Cole, James R., Combination Gas Controls, RSES: The HVACR Training Authority, SAM Chapter 64, Section 12, Refrigeration Service Engineers Society, 2009.

Transmittal of Related Applications dated Jun. 18, 2021.

U.S. Patent and Trademark Office, Office Action issued in U.S. Appl. No. 17/038,641 dated Jun. 13, 2022.

United States Patent and Trademark Office, Final Office Action issued in U.S. Appl. No. 17/038,641, 32 pages, dated Nov. 22, 2022.

United States Patent and Trademark Office, Advisory Action issued in U.S. Appl. No. 17/038,641, 5 pages, dated Feb. 28, 2023.

* cited by examiner

OVEN BROILER GAS BURNER FOR COOKING APPLIANCE WITH VARIABLE ELECTROMECHANICAL VALVE

BACKGROUND

Cooking appliances that include ovens, e.g., ranges and wall-mounted ovens, may be powered by various types of heating or cooking elements, with electrical heating elements and gas burners being among the most common. In particular, gas oven burners generally use as an energy source a combustible gas such as natural gas or liquified petroleum (LP) gas (also referred to as propane), and generate heat by combusting and burning the gas. Combustion requires an oxygen source; therefore, gas ovens include one or more inlets to pull air into the gas oven and also one or more vents or outlets to exhaust hot air and combustion products.

Gas ovens are designed to operate cleanly and efficiently; however, one challenge associated with gas ovens is that combustion characteristics of gas ovens can vary based upon the internal temperature and air flow within a gas oven, as well as the temperatures of the gas burners themselves. When a gas oven is warm and running for a time, natural convection occurs making thermal gradients and air flow paths develop and reach a steady state, pulling air into the inlets and exhausting hot air and combustion products out of the vents. However, during warm-up of a gas oven, i.e., from the point where the gas oven is cold and a gas burner is first ignited, the thermal gradients and flow paths are not yet established within the gas oven, which generally results in sub-optimal combustion and gas burner operating characteristics as the gas oven struggles to draw in its air supply and exhaust combustion products. For example, the sub-optimal burner operating characteristics may include flame lifting, incomplete combustion, and increased carbon monoxide generation that may persist until thermal gradients and air flow are adequately developed and the temperatures of the oven and gas burner increase.

In addition, gas ovens in many cooking appliances include both bake and broiler gas burners, the former of which are disposed proximate the bottom of an oven cavity to generate heat used to cook food principally through convection, and the latter of which are disposed proximate the top of the oven cavity to radiate heat downward onto food to sear or brown food. The gas burners used in a gas oven, however, are generally controlled by bi-metal oven valves that operate either fully on or fully off, and the gas burners are cycled on and off in order to control the temperature within the oven cavity. For a broiler gas burner, the fully on position is configured to generate a high output power level to apply sufficient radiant heat to the food being cooked; however, in many instances, particular when the food is close to the broiler gas burner, the food may become burnt in a relatively quick amount of time, even while the inside of the food is not yet fully cooked. Broiling can therefore be a difficult type of cooking operation to perform for many users. It is time sensitive, and may require adjustment based on rack position, type of food, and/or type of food pan or container, among other variables.

SUMMARY

The herein-described embodiments address these and other problems associated with the art by utilizing a variable electromechanical valve to regulate an output power level of an oven broiler gas burner for a cooking appliance. Among other benefits, in some instances broiler control during cooking may be decoupled from oven warm-up, and in some instances support may be provided for automatic and/or user controlled broiler output power levels and/or automated broil profiles.

Therefore, consistent with one aspect of the invention, a cooking appliance may include a housing including an oven cavity, a broiler gas burner positioned proximate a top of the oven cavity to generate heat within the oven cavity, a variable electromechanical valve configured to couple the broiler gas burner to a gas supply and to regulate an output power level of the broiler gas burner within a range of output power levels that are reduced relative to a maximum output power level of the broiler gas burner, and a controller in communication with the variable electromechanical valve, the controller configured to, during a broil operation, control the variable electromechanical valve to operate the broiler gas burner at a reduced output power level within the range of output power levels for at least a portion of the broil operation.

In some embodiments, the controller is configured to control the variable electromechanical valve to operate between fully open and fully closed states, and the fully open state causes the broiler gas burner to operate at the maximum output power level. Also, in some embodiments, the variable electromechanical valve includes a voice coil controlled modulating valve, a stepper motor controlled modulating valve, or an electronically-actuated plug type valve.

In some embodiments, the reduced output power level is a first reduced output power level, the controller is further configured to perform an oven warm-up operation in association with performing the broil operation to warm-up the oven cavity, and the controller is configured to control the variable electromechanical valve to operate the broiler gas burner at a second reduced output power level within the range of output power levels for at least a portion of the warm-up operation. In addition, in some embodiments, the first and second reduced output power levels are different from one another. In some embodiments, the controller is further configured to control the variable electromechanical valve to automatically change the output power level for the broiler gas burner to a user-selected preset upon completion of the oven warm-up operation. In addition, in some embodiments, the controller is further configured to adjust the output power level for the broiler gas burner in response to user input received after completion of the oven warm-up operation. Moreover, in some embodiments, the controller is configured to control the variable electromechanical valve to operate the broiler gas burner at the second reduced output power level for at least the portion of the oven warm-up operation by controlling the variable electromechanical valve to operate the broiler gas burner at a first output power level during a first portion of the oven warm-up operation, controlling the variable electromechanical valve to operate the broiler gas burner at a second output power level that is lower than the first level during a second portion of the oven warm-up operation that is after the first portion, and controlling the variable electromechanical valve to operate the broiler gas burner at third output power level that is higher than the second level during a third portion of the oven warm-up operation that is after the second portion.

In some embodiments, the controller is configured to determine the reduced output power level in response to a user-selected preset. Moreover, in some embodiments, the user-selected setting is received through a variable control on a control panel of the cooking appliance. In some embodiments, the controller is configured to automatically determine the reduced output power level. In addition, in some embodiments, the controller is configured to automatically determine the reduced output power level in response to user input. In some embodiments, the user input specifies one or more of a type of food being cooked, a temperature of food being cooked, a rack position of food being cooked, a type of pan housing food being cooked, a size of pan housing food being cooked, or a heat intensity to be applied to food being cooked. Moreover, in some embodiments, the controller is configured to automatically determine the reduced output power level based on one or more of a type of food being cooked, a temperature of food being cooked, a rack position of food being cooked, a type of pan housing food being cooked, a size of pan housing food being cooked, or a heat intensity to be applied to food being cooked.

Also, in some embodiments, the controller is configured to control the variable electromechanical valve to operate the broiler gas burner at a plurality of output power levels within the range of output power levels based upon a multi-level broil profile. In some embodiments, the controller is configured to transition between the plurality of output power levels based on time or temperature within the oven cavity. In addition, in some embodiments, the reduced output power level is a first reduced output power level, the cooking appliance further includes a bake gas burner positioned proximate a bottom of the oven cavity to generate heat within the oven cavity, and the controller is further configured to perform a cooking operation using the bake gas burner and to control the variable electromechanical valve during the cooking operation to cycle the broiler gas burner at a second reduced output power level during the cooking operation. Also, in some embodiments, the variable electromechanical valve is a first variable electromechanical valve, the cooking appliance further includes a second variable electromechanical valve configured to couple the bake gas burner to the gas supply and to regulate an output power level of the bake gas burner within a range of output power levels that are reduced relative to a maximum output power level of the bake gas burner, and the controller is configured to control the second variable electromechanical valve during the cooking operation to regulate a temperature in the oven cavity during the cooking operation.

Moreover, in some embodiments, the cooking appliance further includes a bake gas burner positioned proximate a bottom of the oven cavity to generate heat within the oven cavity, the variable electromechanical valve is a first variable electromechanical valve, the cooking appliance further includes a second variable electromechanical valve configured to couple the bake gas burner to the gas supply and to regulate an output power level of the bake gas burner within a range of output power levels that are reduced relative to a maximum output power level of the bake gas burner, and the controller is configured to control each of the first and second variable electromechanical valves to maintain a combined output power level of the broiler gas burner and the bake gas burner at or below about half of a combined maximum output power level for the broiler gas burner and the bake gas burner and/or at or below a maximum output power level for one of the broiler gas burner and the bake gas burner.

Consistent with another aspect of the invention, a cooking appliance may include a housing including an oven cavity, a broiler gas burner positioned proximate a top of the oven cavity to generate heat within the oven cavity, a bake gas burner positioned proximate a bottom of the oven cavity to generate heat within the oven cavity, a first variable electromechanical valve configured to couple the broiler gas burner to a gas supply and to regulate an output power level of the broiler gas burner within a first range of output power levels that are reduced relative to a maximum output power level of the broiler gas burner, a second variable electromechanical valve configured to couple the bake gas burner to the gas supply and to regulate an output power level of the bake gas burner within a second range of output power levels that are reduced relative to a maximum output power level of the bake gas burner, and a controller in communication with the first and second variable electromechanical valves, the controller configured to, during a cooking operation, control the first and second variable electromechanical valves to operate the broiler gas burner and the bake gas burner at respective reduced output power levels within the respective first and second ranges of output power levels for at least a portion of the cooking operation.

Consistent with another aspect of the invention, a method of operating a cooking appliance may include supplying gas to a broiler gas burner positioned proximate a top of an oven cavity to generate heat within the oven cavity using a variable electromechanical valve configured to regulate an output power level of the broiler gas burner within a range of output power levels that are reduced relative to a maximum output power level of the broiler gas burner, and during a broil operation, and using a controller in communication with the variable electromechanical valve, controlling the variable electromechanical valve to operate the broiler gas burner at a reduced output power level within the range of output power levels for at least a portion of the broil operation.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

In the embodiments discussed hereinafter, a variable electromechanical valve may be used to regulate an output power level of an oven broiler gas burner for a cooking appliance. Among other benefits, in some instances broiler control during cooking may be decoupled from oven warm-up, thereby enabling different output power levels to be used during a warm-up operation and a broil operation using the same oven broiler gas burner. Further, in some instances the use of a variable electromechanical valve may enable the implementation of automatic and/or user controlled broiler output power levels and/or automated broil profiles.

Figure 1:
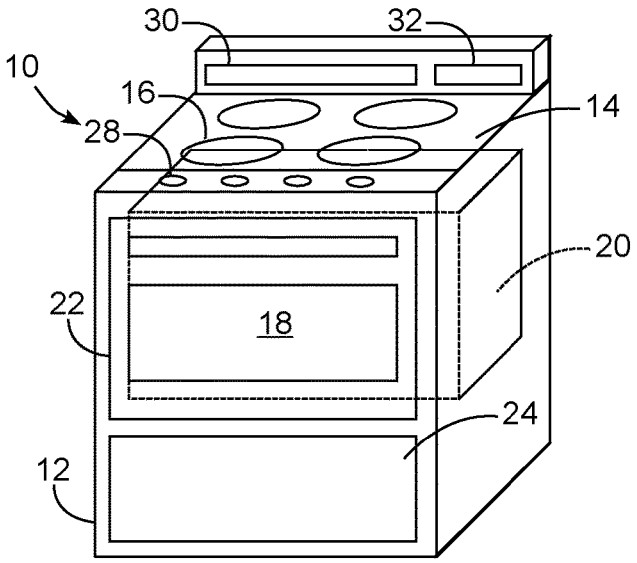
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas heating elements.

Cooking appliance 10 may also include various user interface devices, including, for example, control knobs 28 for controlling burners 16, a control panel 30 for controlling oven 18 and/or burners 16, and a display 32 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 32 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app.

Display 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a wall mount or freestanding oven. In general, a cooking appliance consistent with the invention may be considered to include any residential-type appliance including a housing and one or more cooking elements disposed therein and configured to generate energy for cooking food within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a stovetop, one or more cooking elements therein may be gas, electric, or inductive heating elements in some embodiments. Further, it will be appreciated that any number of cooking elements may be provided in a cooking appliance (including multiple cooking elements for performing different types of cooking cycles such as baking or broiling), and that multiple types of cooking elements may be combined in some embodiments, e.g., combinations of microwave and light cooking elements in some oven embodiments.

In the case of the embodiments discussed hereinafter, at least one of the cooking elements for the oven includes a gas burner and an associated multi-level valve system that couples the gas burner to a gas supply, along with any ignition system utilized to ignite the gas burner in the presence of gas supplied from the multi-level valve system.

Figure 2:
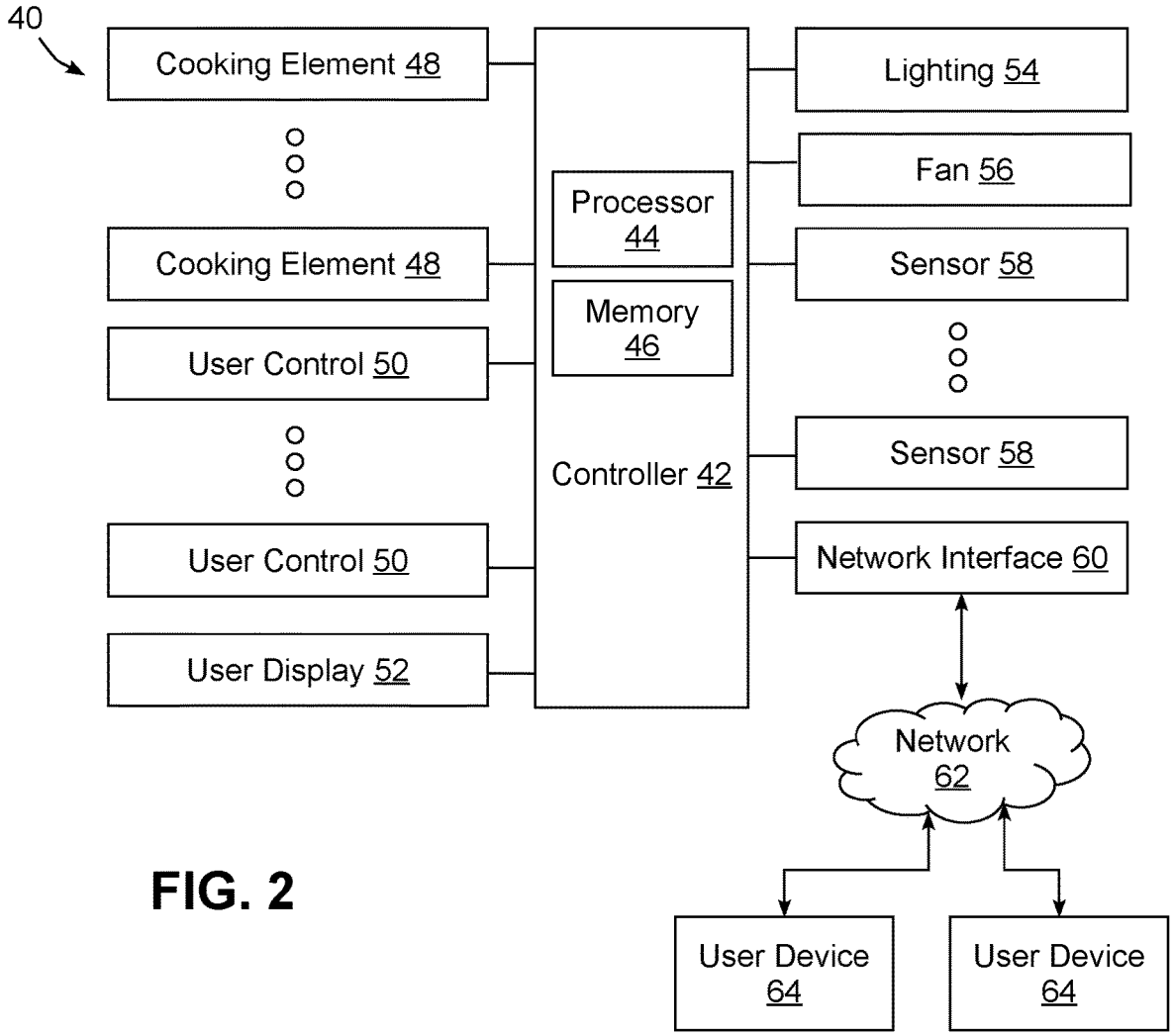
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Cooking Appliance Gas Oven Burner Control During Oven Warm-Up Operation

As noted above, one challenge associated with gas ovens is that combustion characteristics of gas ovens can vary based upon the internal temperature and air flow within a gas oven, as well as the temperatures of the gas burners themselves. When a gas oven is warm and running for a time, natural convection occurs and thermal gradients and air flow paths develop and reach a steady state, pulling air into inlets and exhausting hot air and combustion products out of vents. However, during warm-up of a gas oven, i.e., from the point where the gas oven is cold and a gas burner is first ignited, the thermal gradients and flow paths are not yet established within the gas oven, which generally results in sub-optimal combustion and gas burner operating characteristics as the gas oven struggles to draw in its air supply and exhaust combustion products. For example, the sub-optimal burner operating characteristics may include flame lifting, incomplete combustion, and increased carbon monoxide (CO) generation that may persist until thermal gradients and flows are adequately developed and the temperatures of the gas burner increases.

The sub-optimal burner operating characteristics can further increase as the output power level of a gas burner increases; however, higher output power levels are generally desirable in order to improve oven or broiler performance. In the United States, for example, under the ANSI Z21.1 standard for household cooking gas appliances, gas ovens are generally required to reach air free CO levels below 800 ppm 5 minutes after ignition of a gas burner; however, it has been found that when higher output power level gas burners are used, it can be difficult to meet this standard. Air free, which may also be referred to as "undiluted Carbon Monoxide," is a measure of the CO that removes the effect of excess air that flows through an oven but isn't involved in the combustion process, or air near the sample probe that gets pulled in. In order to measure air free CO, both carbon monoxide (CO) and carbon dioxide ($CO_2$) levels are measured with a probe, and a calculation is made based upon the type of gas being combusted. When $CO_2$ is generated in the combustion of methane, for example, the maximum theoretical percentage of $CO_2$ among the combustion products (also referred to as $CO_2$ ultimate) is 11.7% (see box below for calculation), resulting in an air free CO calculation as shown in Eq. (1) below:

$$\text{Air free } CO = (CO \text{ measured}) * (11.7\% / (CO_2\% \text{ measured})) \quad (1)$$

Thus, for example, if 6.5% $CO_2$ and 85 ppm CO are measured with a probe, the air free CO would be 85 ppm*(11.7%/6.5%)=153 ppm air free CO. It will be appreciated that for other types of gas, $CO_2$ ultimate will be different, and thus another constant may be applied in Eq. (1) as appropriate.

Embodiments consistent with the invention address this challenge in part by using a multi-level valve system to control or regulate the output power level of a gas burner during an oven warm-up operation such that, at least during a portion of the oven warm-up operation, the gas burner is operated at a reduced output power level relative to a maximum output power level for the gas burner.

In this regard, an oven warm-up operation may be considered to be an operation that is performed at the beginning of a cooking operation to bring an oven cavity up to an operating temperature, generally starting from a cold (e.g., room) temperature if the oven has not been used for some time. An oven warm-up operation in some embodiments may be performed at least until a temperature is established in the oven cavity that is sufficient to establish suitable flow thermal flow gradients and flow paths within the oven cavity and/or to heat the gas burner to a temperature that is suitable for establishing suitable burner operating characteristics for the gas burner. In this case of a gas burner used as a baking gas burner, which is generally positioned proximate a bottom of an oven cavity, the oven warm-up operation may optionally be used to raise the temperature within the oven cavity to a desired user set point. In the case of a gas burner used as a broiler gas burner, however, no temperature set point may be used to determine the completion of an oven warm-up operation. In other embodiments, however, temperature set points may be used for a warm-up operation performed with a broiler gas burner. Further, in some embodiments, a warm-up operation may simply execute for a predetermined amount of time.

An output power level of a gas burner refers to the amount of energy that is emitted by a gas burner, e.g., in British Thermal Unit (BTU)/hr, kW/hr or another suitable measurement. Also, a maximum output power level refers to the maximum amount of energy that can be emitted by the gas burner based upon a given gas supply and any supply lines, valves, regulators, burner orifices, and other components between the gas burner and the gas supply. In the illustrated embodiments, for example, the maximum output power level for a gas burner that is regulated by a multi-level valve system may be considered to be the highest output power level that can be obtained from the gas burner when the multi-level valve system is set to output a maximum flow of gas to the gas burner, e.g., when the multi-level valve system is set to minimize the amount in which gas flow is restricted through the multi-level valve system. A reduced output power level, in turn refers to an output power level that is below the maximum output power level, but that is at least at a minimum active output power level that is sufficient to maintain an active flame with the gas burner.

Figure 3:
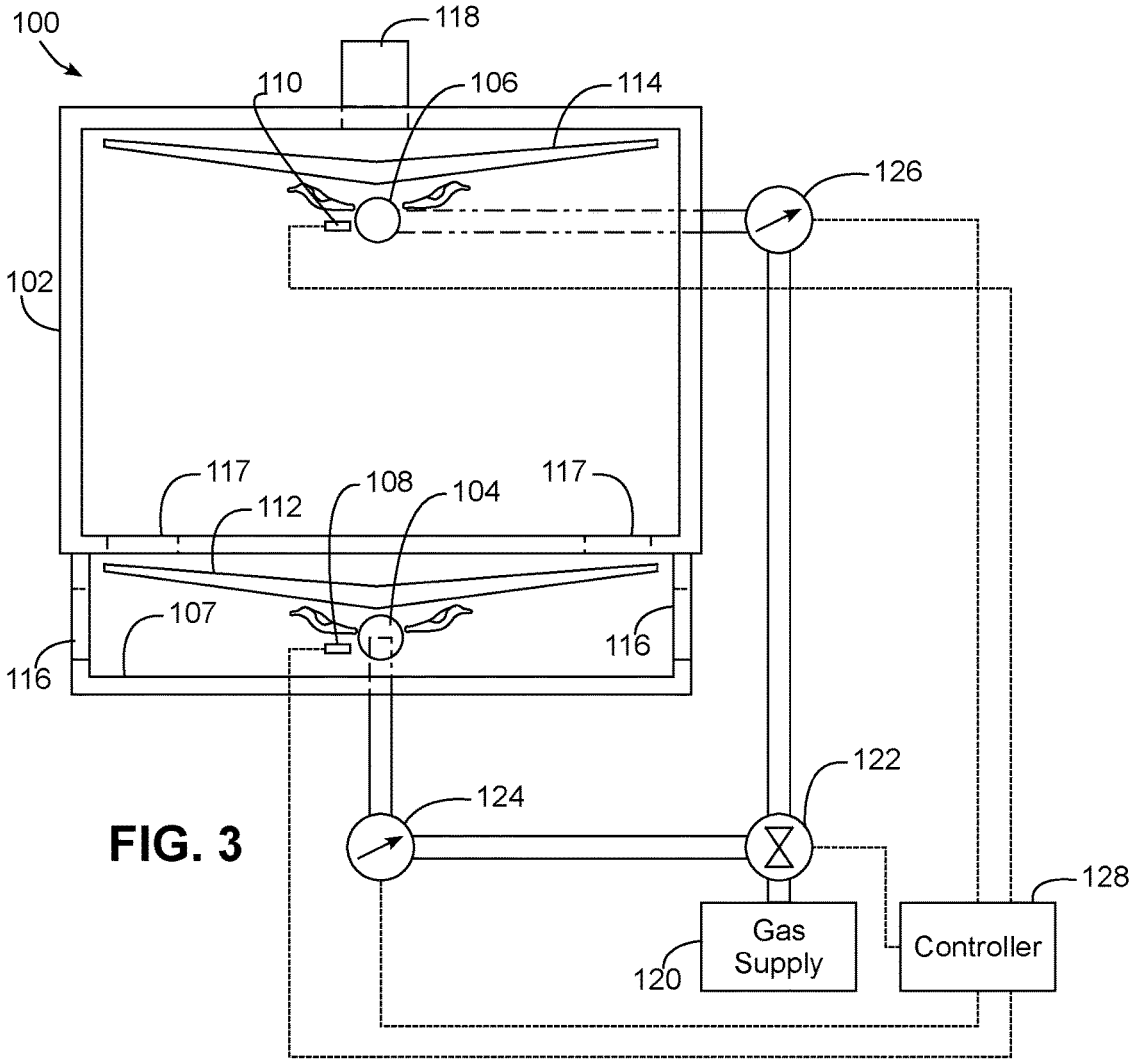
FIG. 3 is a block diagram of an example cooking appliance oven control system consistent with some embodiments of the invention.

Now turning to FIG. 3, a portion of a cooking appliance 100 directed to control over an oven is illustrated in greater detail. Cooking appliance 100 includes an oven cavity 102 within which is disposed a bake gas burner 104 and a broiler gas burner 106 respectively disposed proximate the bottom and the top of oven cavity 102. In some instances, a gas burner may be positioned inside of the oven cavity (as is the case for broiler gas burner 106), while in other instances a gas burner may be disposed outside of but adjacent to a top or bottom wall of an oven cavity (e.g., as is the case for bake gas burner 104, which is disposed in a separate burner box 107). Each gas burner 104, 106 generally includes an ignitor 108, 110 to ignite the burner and a flame spreader or diffuser 112, 114. In some instances, flame spreader or diffuser 112 may be integrated into an oven cavity bottom.

Air for use in combustion is generally received through one or more air inlets 116 disposed proximate the bottom of the oven cavity and heated air and combustion products generally exit the oven cavity through one or more vents 118. One or more additional inlets 117 may also be provided in the bottom of the oven cavity, or elsewhere on the appliance, to allow for the flow of both fresh air for use by broiler gas burner 106 and heat and combustion products generated by bake gas burner 104. It will be appreciated that when an oven reaches a steady state heated condition, thermal gradients and flow paths will generally be established such that air received through the inlet is used to substantially fully combust the gas output by each gas burner 104, 106 and any combustion products will flow out of the vent. It will also be appreciated that the size of the vent can also affect oven performance since heat is also lost from the oven cavity as air and combustion products exit the vent, and the larger the vent, the faster heat escapes the oven cavity.

In the illustrated embodiment, each gas burner 104, 106 is coupled to a gas supply that is functionally represented by block 120 through a safety or master shut off valve 122 and a respective multi-level valve system 124, 126. In the illustrated embodiment, each multi-level valve system 124, 126 is implemented as a variable electromechanical valve that is configured to control the output power level of the respective gas burner 104, 106 within a range of output power levels, e.g., within a continuous range between fully open and fully closed states for the valve in some instances, or within some sub-range between the fully open and fully closed states in other instances. In some embodiments, each multi-level valve may be implemented as a voice coil controlled modulating valve, a stepper motor controlled modulating valve, or an electronically-actuated plug type valve in various embodiments, or using other types of electrically-controllable variable valves as will be appreciated by those of ordinary skill having the benefit of the instant disclosure.

While in the illustrated embodiment, both a bake gas burner and a broiler gas burner are controlled using a multi-level valve system, it will be appreciated that in other embodiments multiple bake and/or broiler gas burners may be used, while in other embodiments, a bake or broiler gas burner may not be controlled by a multi-level valve system, but may be controlled only using an on/off valve that supports only a single level of power level output for the burner. In still other embodiments, a different type of cooking element may be used instead of a bake or broiler gas burner, or bake or broiler functionality may be omitted entirely in some embodiments. Therefore, the invention is not limited to an oven including both bake and broiler gas burners regulated by multi-level valve systems as is illustrated in FIG. 3.

A controller 128 is coupled to valve 122, multi-level valve systems 124, 126 and ignitors 108, 110 to perform various cooking operations, e.g., bake operations, broil operations, roast operations, convection cooking operations, etc. Controller 128 may also be perform other operations such as self-clean operations. Further, as will be described in greater detail below, controller 128 may be configured to perform oven warm-up operations during or otherwise associated with cooking and other operations to control warm-up of oven cavity 102 in a manner that reduces emissions and improves performance during the warm-up operations.

Figure 4:
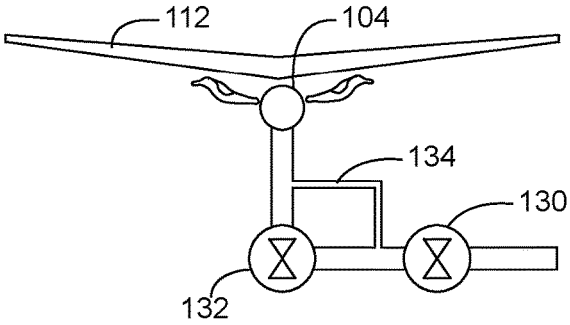
FIG. 4 is a block diagram of an alternate multi-level valve system to that utilized in the oven control system of FIG. 3.

As noted above, multi-level valve system 124, 126 are implemented as variable electromechanical valves; however, other types of valves may be utilized in other embodiments. FIG. 4, for example, illustrates an alternate multi-level valve system for gas burner 104 that utilizes a pair of on/off valves 130, 132 that are coupled in series with one another and that include a bypass flow line 134 that is coupled in parallel with on/off valve 132 to supply a predetermined flow rate of gas from the gas supply to gas burner 104 when on/off valve 130 is set to an on position and on/off valve 132 is set to an off position. In some embodiments, bypass flow line 134 may be designed with a predetermined flow rate, while in other embodiments, an additional valve may be supplied in the bypass flow line to set the desired predetermined flow rate, e.g., during manufacture or setup of the appliance. On/off valves 130, 132 thus support two different gas flow rates, and thus two different output power levels for gas burner 104, one of which, corresponding to both valves 130, 132 being set to on positions, providing a maximum output power level for the gas burner in some embodiments, with the other, corresponding to valve 130 being in an on position and valve 132 being in an off position, providing a reduced output power level for the gas burner, effectively controlled by bypass flow line 134. In the illustrated embodiment, for example, it may be desirable to configure bypass flow line 134 (or set a valve disposed therein) to provide at least a minimum flow rate of gas corresponding to a minimum active output power level for the gas burner. It will also be appreciated that additional on/off valves and bypass lines may be incorporated to support additional output power levels in other embodiments.

Figure 5:
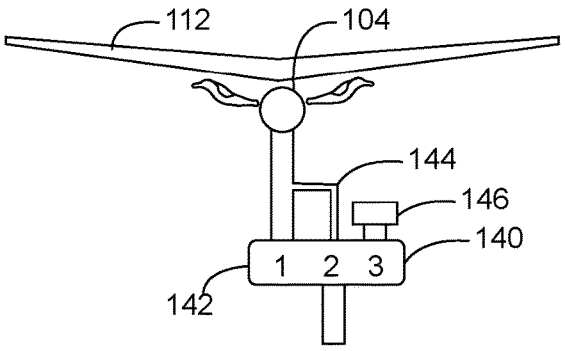
FIG. 5 is a block diagram of another alternate multi-level valve system to that utilized in the oven control system of FIG. 3.

FIG. 5 illustrates another example alternate implementation of a multi-level valve system for gas burner 104, which utilizes a multi-position diverter valve 142 that supports both an off position and a plurality of on positions that output gas from the gas supply at differing flow rates, and thus support different output power levels for gas burner 104. Diverter valve 142, for example, supports two on positions, a first on position 142 that is configured to supply gas at a sufficient rate to operate the gas burner at a maximum output power level and a second on position 144 that is configured to restrict gas flow relative to on position 142 to operate the gas burner at a reduced output power level. In some embodiments, the second on position 142 may be configured to provide at least a minimum flow rate of gas corresponding to a minimum active output power level for the gas burner. An off position, represented by capped outlet 146, is used to shut off gas flow to the gas burner. It will also be appreciated that more than two different on positions may be supported in other embodiments.

It will also be appreciated that in other embodiments, a multi-level valve system may not be configured to completely shut off gas flow to a gas burner, such that another valve that is external to the multi-level valve system is used to shut off gas flow. Other types of valve systems that support multiple flow rates, whether multiple discrete flow rates or multiple flow rates within a range of flow rates, may also be used in other embodiments.

Figure 6:
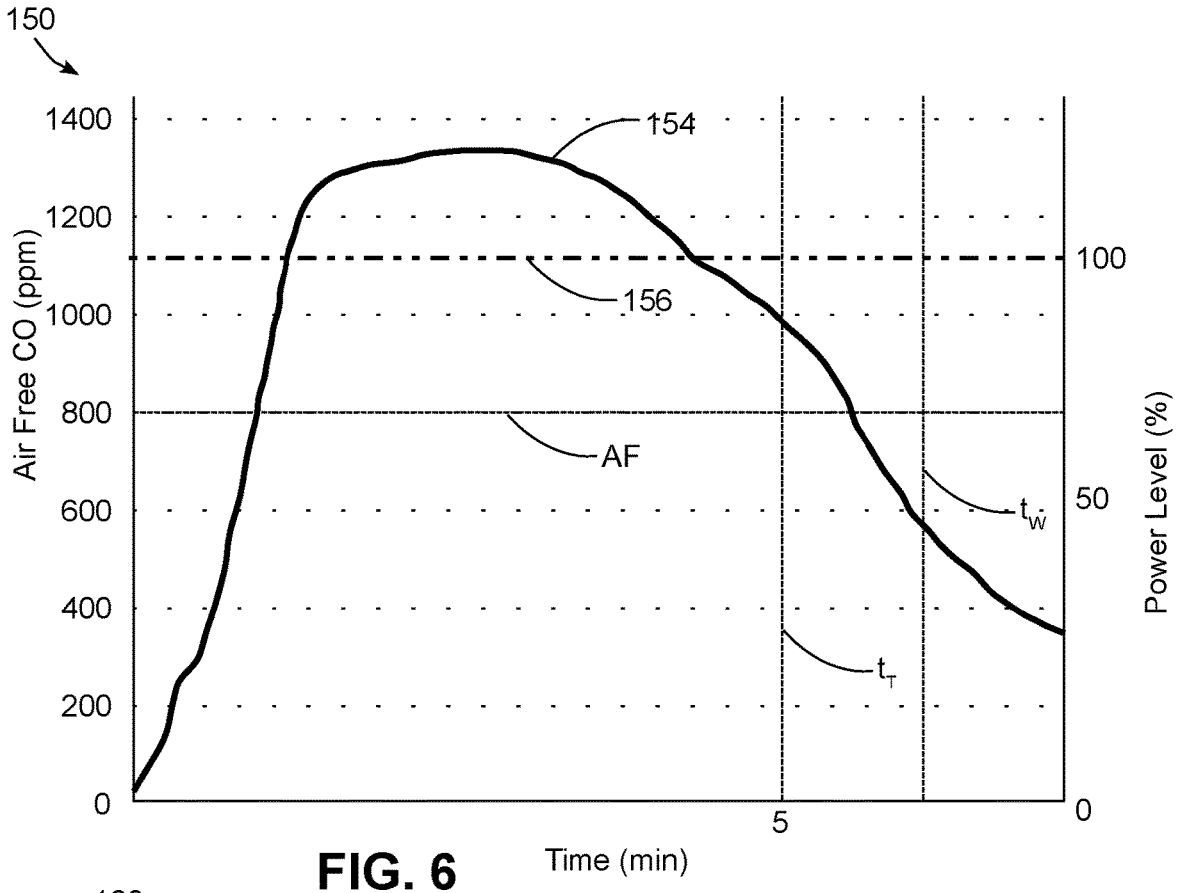
FIG. 6 is a graph illustrating air free CO levels during a representative oven warm-up operation utilizing a gas burner operated at a maximum output power level during the oven warm-up operation.

Now turning to FIG. 6, as noted above, the aforementioned ANSI standard mandates that air free CO levels be below 800 ppm 5 minutes after ignition of a gas burner. Graph 150, for example, illustrates a representative plot 154 of air free CO emissions over time during an oven warm-up operation conducted using a gas burner that is operable only using an on/off control and performed over a time period that extends to time $t_W$, representing the end of the warm-up operation, such that the output power level of the gas burner is at a maximum output power level (100%, represented by dashed line 156) throughout the oven warm-up operation. The aforementioned standard applies a maximum air free CO level of 800 ppm at 5 minutes, represented by horizontal dashed line AF and vertical dashed line $t_T$, respectively. It can be seen from this figure that the air free CO level exceeds the 800 ppm at 5 minute requirement. As a consequence, it is generally required for a smaller, lower maximum output power level gas burner to be used to comply with the standard for a given oven and vent design, which can decrease the efficiency and performance of the oven.

Figure 7:
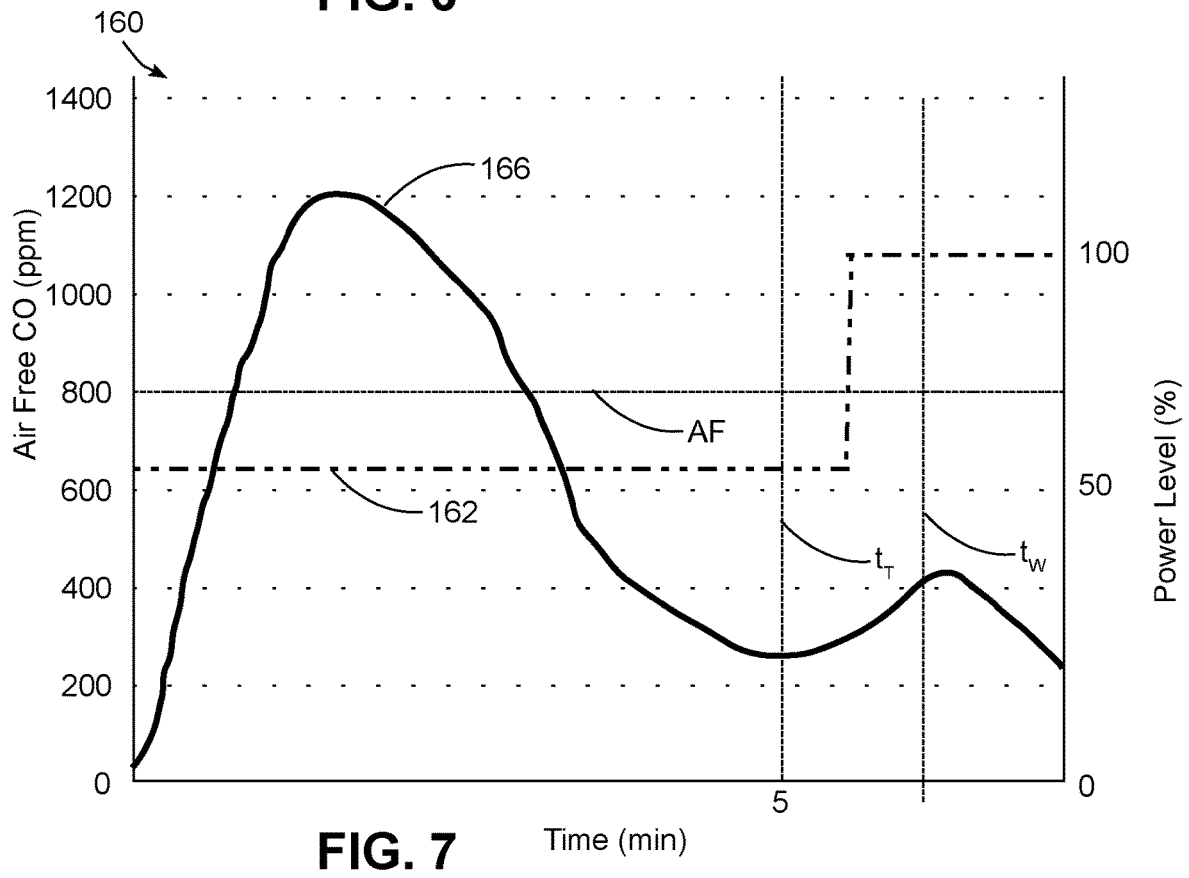
FIG. 7 is a graph illustrating air free CO levels during a representative oven warm-up operation utilizing a gas burner profile that operates a gas burner operated at a reduced output power level during at least a portion of the oven warm-up operation.

FIG. 7, on the other hand, illustrates a graph 160 in which a gas burner profile used during an oven warm-up operation, represented by dashed line 162, begins at a reduced output power level (e.g., between about 50% and about 75%) for a first portion of the oven warm-up operation. During this time, the maximum (peak) level for air free CO (represented by line 166) is lower compared to that of FIG. 6, and the level falls off more quickly as the thermal gradients and flow paths are established and the gas burner heats up, resulting in an air free CO level that is below the 800 ppm level at 5 minutes.

Figure 8:
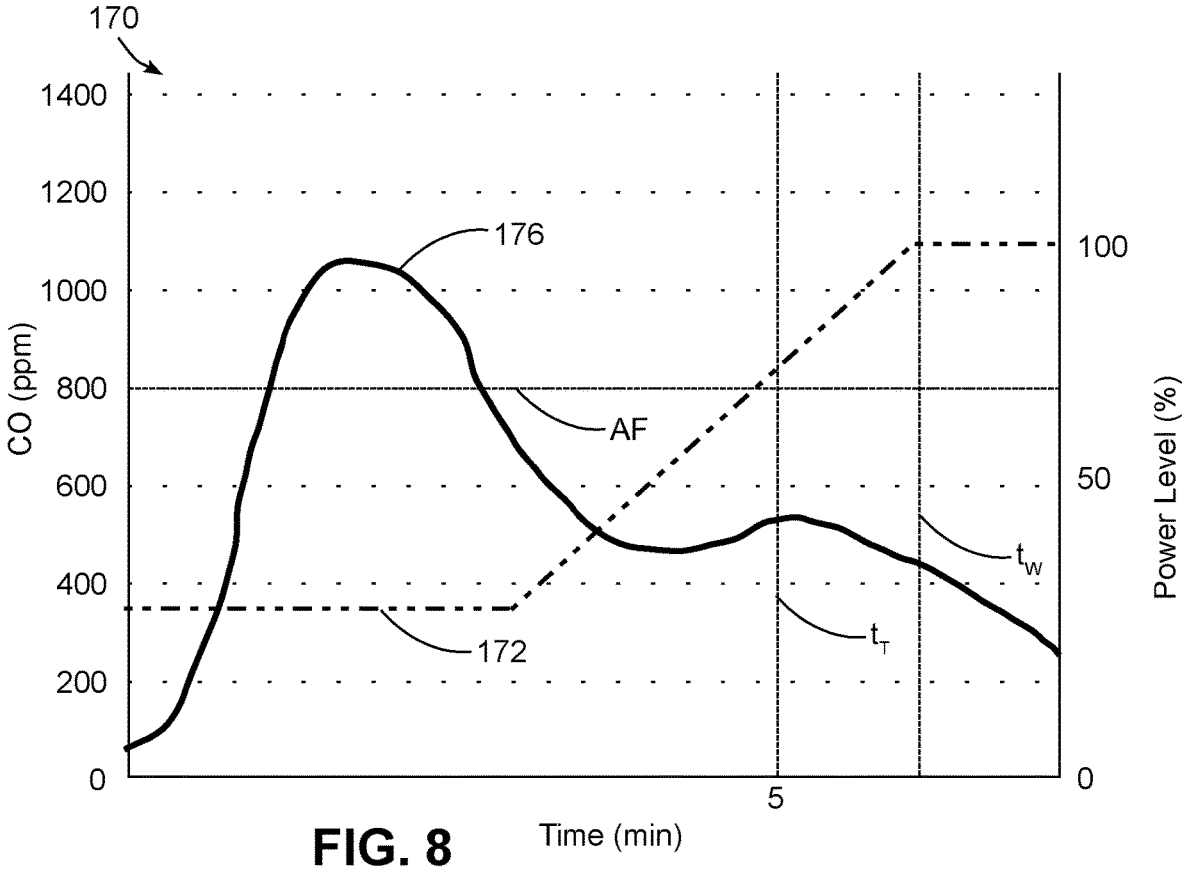
FIG. 8 is a graph illustrating air free CO levels during a representative oven warm-up operation utilizing another gas burner profile that operates a gas burner at a reduced output power level during at least a portion of the oven warm-up operation.

Similarly, FIG. 8 illustrates a graph 170 in which a gas burner profile used during an oven warm-up operation, represented by dashed line 172, does not merely incorporate a single step from a reduced output power level to a maximum output power level, but rather incorporates a reduced output power level during a first portion of the warm-up operation and continuing with a second portion including a gradual increase from a reduced output power level to the maximum output power level, and which results in a similar plot 176 for air free CO levels that meets the 800 ppm level at 5 minutes requirement. Such a profile, for example, may be implemented using a variable electromechanical valve such as valves 124, 126 of FIG. 3, which are adjustable within a range of output power levels, such that the output power level of a gas burner may be progressively increased over time.

It will be appreciated that, depending upon whether a multi-level valve system supports ranges of output power levels or multiple discrete output power levels, various types of profiles may be supported during an oven warm-up operation, including profiles that incorporate zero or more discrete steps between discrete output power levels and zero or more varying transitions between different output power levels within a range of output power levels. It will also be appreciated that specific oven cavity geometry, burner flame spreader geometry, burner design, vent position and design, and/or general appliance design may affect the flow characteristics of the system and therefore different strategies with respect to the burner power levels, timing, and transitions may be used to optimize variables for a given appliance design.

Figure 9:
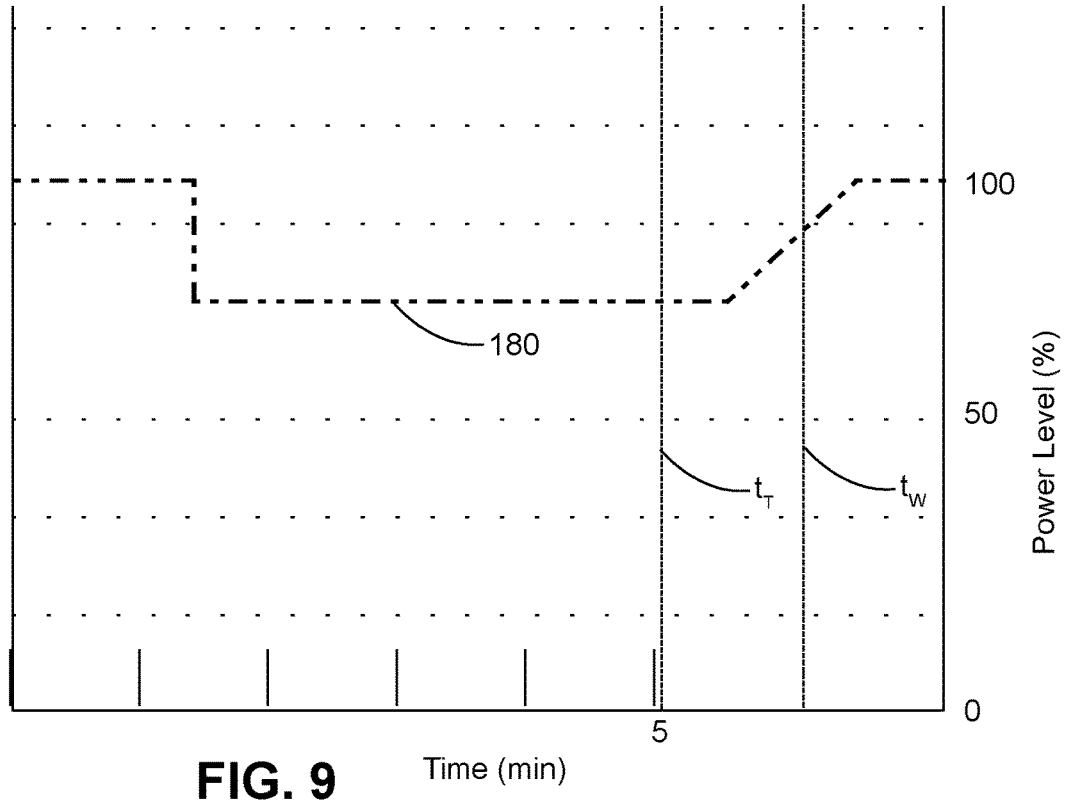
FIGS. 9-11 are graphs illustrating various alternate example gas burner profiles that may be used as alternatives to those illustrated in FIGS. 7 and 8.

FIG. 9, for example, illustrates an example profile 180 in which the portion of a warm-up operation that utilizes a reduced output power level does not occur at the beginning of the warm-up operation, but instead occurs following an initial portion in which the output power level is set to the maximum output power level for the gas burner. In one example embodiment, 1.5 minutes of a maximum output power level followed by 4 minutes of a reduced output power level (e.g., about 75%) and then returning over the course of about 1 minute to a maximum output power level may be suitable for use in some cooking appliance designs.

Figure 10:
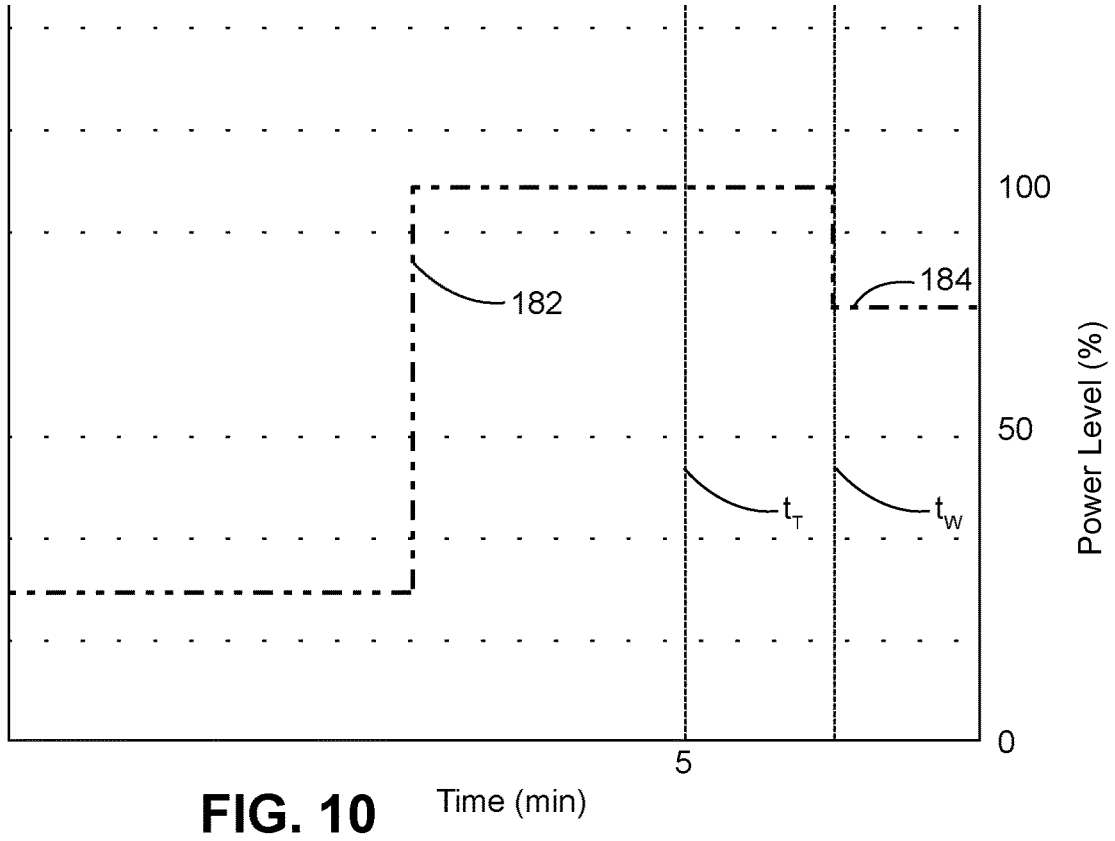

In addition, as illustrated in FIG. 10, it may be desirable, e.g., in designs that utilize a variable electromechanical valve implementation of a multi-level valve system, to allow for a user or programmable setting for a cooking operation to set a gas burner to a different output power level at the completion of an oven warm-up operation. Profile 182, for example, begins with a reduced output power level and then steps up to a maximum output power level until the end of the oven warm-up operation at time $t_W$. Thereafter, a user setting, represented at portion 184, may reduce the output power level of the gas burner to a user-specified level for use in the cooking operation.

Figure 11:
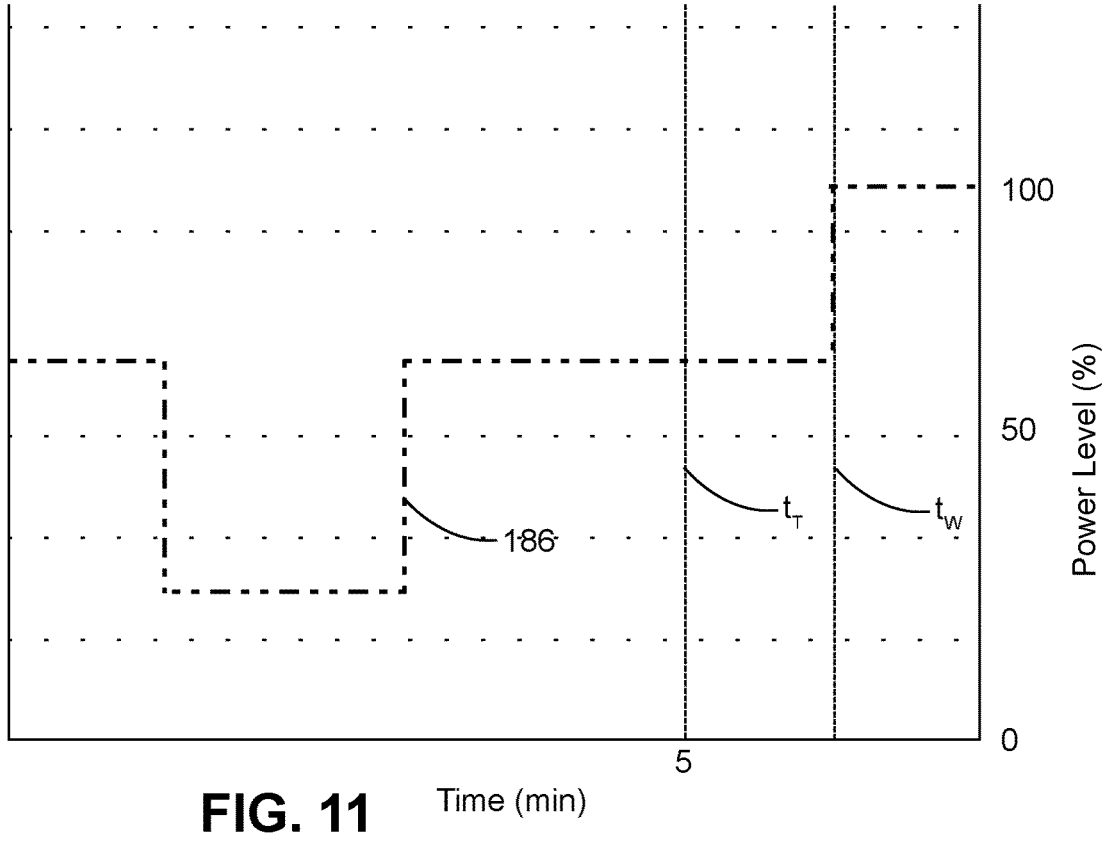

FIG. 11 illustrates yet another example profile 186, which steps between a first, relatively higher, yet still reduced output power level, to a second, relatively lower output power level, and then to a third, relatively higher, yet still reduced output power level, before automatically transitioning to a maximum output power level at the completion of the oven warm-up operation. In some instances, the first and third output power levels may be the same, while in other instances, the first output power level may be higher than the third, or vice versa. Further, in some instances, the output power level transitions may be stepwise, while in other instances, the output power level transitions may be gradual, and performed over a predetermined amount of time.

It will be appreciated that an optimal profile for a given cooking appliance may vary depending upon the design of the cooking appliance, and may drive selection of various design parameters of a cooking appliance. For example, given that the vent size used in a gas oven is often dictated by the broiler gas burner maximum output power level, some profiles, e.g., profile 180 of FIG. 9, may be suitable for allowing a higher ultimate broiler power output level for a given oven vent size, or alternatively allow for a reduction in vent size while maintaining the same output power level for the broiler gas burner, thus improving pre-heat times during bake, improved thermal efficiency and better self-clean performance due to the reduced vent size.

In general, the various profiles discussed herein may be usable to lower emissions during an oven warm-up operation, improve thermal efficiency for an oven for a given gas burner maximum output power level (by reducing the vent size), and thereby reducing pre-heat times when baking and improving self-clean performance (since a smaller oven vent generally allows an oven to reach a higher ultimate temperature in self-clean mode for a given gas burner output power level, and otherwise reduces the heat loss rate). Higher gas burner maximum output power levels may also be achievable while still complying with emissions standards.

The time at which a controller may transition a gas burner between different output power levels may also vary in different embodiments. In some embodiments, for example, profiles, and the transition times between different output power levels, may be hard coded, and may, in some instances, be empirically determined for a particular cooking appliance design. In other embodiments, however, transition times and/or output power levels may be determined dynamically, e.g., to account for the current state of the oven prior to and/or during an oven warm-up operation. For example, if a new cooking operation is started soon after a prior cooking operation has completed, such that the temperature in the oven cavity is still substantially above room temperature, the aforementioned concerns regarding sub-optimal burner operating characteristics may not be present, and as such, it may be desirable to modify or simply bypass an oven warm-up operation. In some embodiments, for example, a temperature sensor in the oven cavity may be used to sense a temperature in the oven cavity, and a controller may control the time in which a change occurs between different output power levels based upon the sensed temperature in the oven cavity. Alternatively, a controller may simply track the completion of a prior cooking operation such that the time in which a change occurs between different output power levels is based upon the duration since the prior cooking operation, with the assumption being that the oven cavity will remain hot for some period of time after the cooking operation has completed. It will be appreciated that suitable numbers and configurations of profile steps, output power levels at each step, oven vent sizes, gas burner maximum output power levels, and multi-level valve system designs may be determined empirically in different embodiments.

Oven Broiler Gas Burner with Variable Electromechanical Valve

As noted above, while some embodiments may utilize the above-mentioned techniques in connection with a bake gas burner in a gas oven, in other embodiments, these techniques may be used in a connection with a broiler gas burner. The gas burners used for broil operations in gas ovens have generally been single-level gas burners, and capable of only being turned on or off. Broiling, however, generally applies high levels of radiant heat to food such that achieving a desired sear or browning of food without overcooking or burning the food can require a user to closely monitor a broil operation.

In various embodiments consistent with the invention, an electronically-controlled variable electromechanical valve may be used to regulate a broiler gas burner to provide greater control and flexibility over a broil operation. In some embodiments, for example, an output power level for a broiler gas burner may be controlled based upon a user-selected preset or based upon an automated determination by a controller. In either instance, various factors may be used to determine an appropriate output power level to be used during a broil operation, including, for example, the type of food being cooked, the temperature of the food being cooked, the rack position of the food being cooked, the type and/or size of pan housing the food being cooked, and/or the desired heat intensity to be applied to the food being cooked. The type of food, for example, may include the food ingredients (e.g., various meats, vegetables, dairy products, grains, etc.), the thickness of the food, the weight of the food, the volume of the food, the density of the food, etc. The temperature of the food may include a sensed temperature, e.g., as sensed by a probe, a thermistor, an infrared thermometer, etc. The rack position may include a rack position number or a distance of the food or pan from the broiler gas burner (e.g., as input by a user or sensed by a sensor). The type and/or size of pan may include information regarding the pan being used (e.g., a broil pan, a cookie sheet, a casserole dish, a glass dish, a ceramic dish, or no dish at all). The intensity of heat desired may refer to the type of broiling to be performed, e.g., searing, browning, melting, etc.

It will be appreciated that a user may be permitted to select an output power level based upon one or more of the aforementioned factors in some embodiments, while in other embodiments, a controller may automatically select an output power level based upon one or more the aforementioned factors. The controller may do so in some embodiments based upon sensed data, while in other embodiments, a user may input one or more of these factors to the cooking appliance such that the controller may select the appropriate output power level. In some embodiments, a combination of these factors may be associated with particular cycle types, profiles, or recipes, such that an appropriate output power level may be determined accordingly. A cooking appliance in some embodiments may also generate recommendations or instructions to a user in association with selecting an appropriate output power level, e.g., to ensure that the user uses an appropriate pan and/or places the pan on an appropriate rack for which a particular output power level has been selected. Thus, for example, a determination that the food to be cooked is 1 lb. of shrimp on a 13×9 cookie sheet placed on the center rack (whether via a recipe selection, user input and/or sensed data), may result in a particular output power level for the broiler gas burner that is suitable for that combination of factors. Mappings between factors and output power levels may vary for different cooking appliance designs, and may, in some embodiments, be determined through empirical testing.

In addition, in some embodiments, an electronically-controlled variable electromechanical valve may be used to better control a rate of searing, melting or browning by reducing the output power level while extending the time during which a broiler gas burner is active. For example, in some cooking operations, a broiler gas burner may be used in combination with a bake gas burner, and, for example, if a cycle normally requires a broiler gas burner to be on for 1 second at a maximum output power level, a controller in some embodiments of the invention may extend this time while reducing the output power level to avoid temperature spikes that might otherwise be observed by using a higher output power level for a shorter time.

In addition, in some embodiments a cooking appliance may utilize multi-level broil profiles to control a broil operation, during which at each of a plurality of different points, a different broiler gas burner output power level is used. Transitions between profile points may occur based on time (e.g., at 30 seconds, transition to output power level X, or after 15 seconds from the prior profile point, transition to output power level Y) and/or temperature (e.g., transition to output power level Z when oven cavity temperature reaches 450 degrees) in different embodiments.

Figure 12:
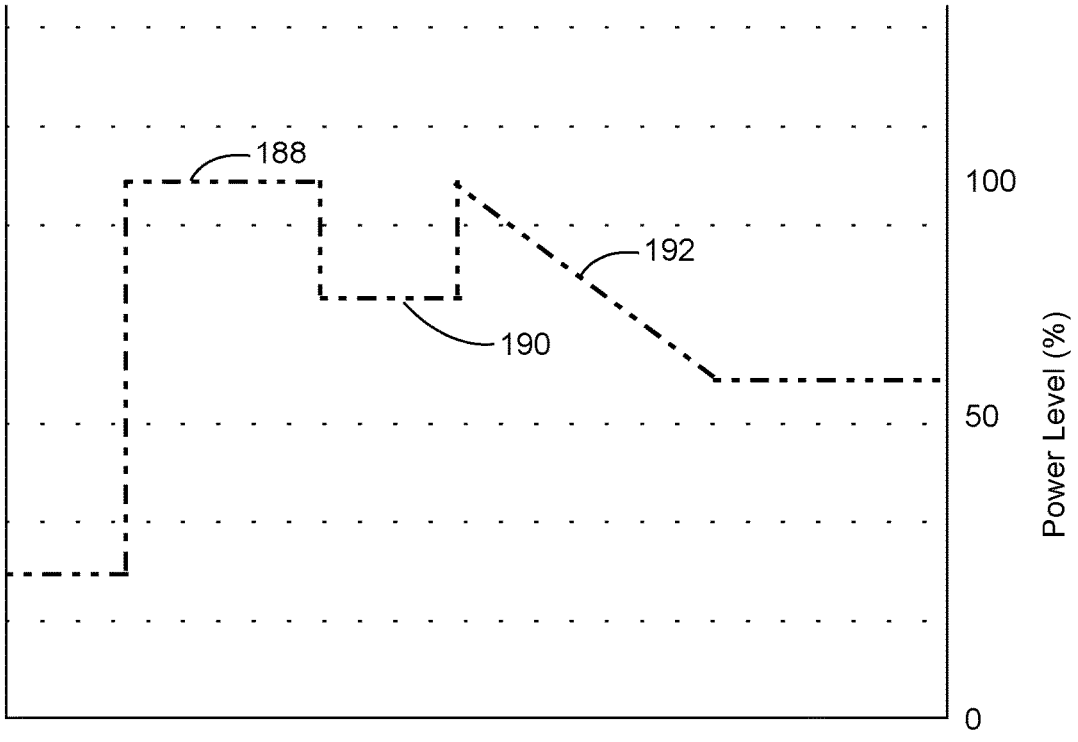
FIG. 12 is a graph illustrating an example broil profile capable of being implemented by the oven control system of FIG. 3.

FIG. 12, for example, illustrates an example multi-level broil profile 188 that may be used in some embodiments. As illustrated by portion 190, in some instances the output power level may be held at the same level during some portions of a profile. As illustrated by portion 192, however, in other instances the output power level may vary, e.g., gradually increase or decrease, during some portions of a profile.

Figure 13:
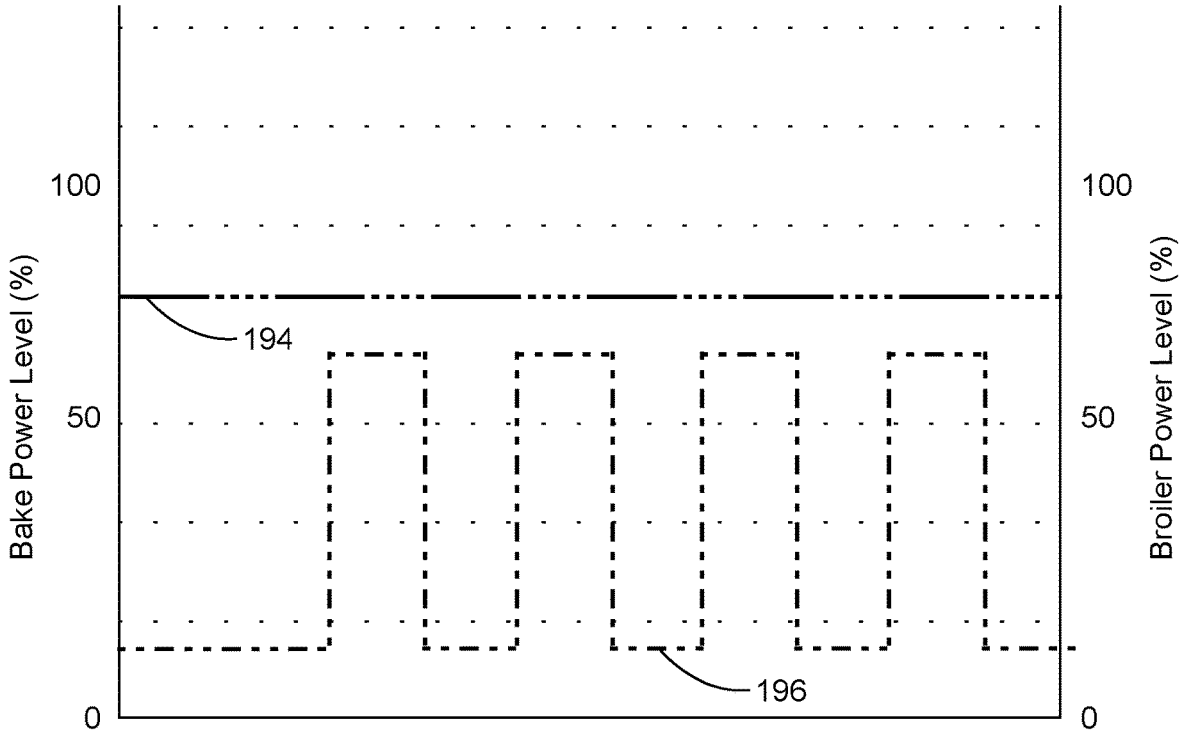
FIG. 13 is a graph illustrating an example cooking profile capable of being implemented by the oven control system of FIG. 3.

In addition, as illustrated in FIG. 13, in some cooking operations that utilize both a bake gas burner and a broiler gas burner, a multi-level profile may be used to control one or both of the gas burners. FIG. 13, in particular, illustrates a multi-level profile where the bake gas burner (represented by line 194) is maintained at a fixed output power level (e.g., to maintain a preset temperature in the oven cavity) while the broiler gas burner (represented by line 196) is cycled between two different output power levels to sear or brown the food being cooked, while minimizing temperature spikes in the oven cavity.

It will be appreciated that with gas burners that are operable only in fully on or fully off states, operating both the bake and broiler gas burners simultaneously is generally not possible, as the combined output power level (i.e., the sum of the respective output power levels) of the two gas burners would overwhelm the oven vent and undesirably increase CO levels. Through the use of multi-level bake and broiler gas burners, however, both gas burners may be operated simultaneously in some embodiments with a lower combined output power level. In some embodiments, for example, the gas burners may be operated to have a combined output power level that is maintained at or below about half of a combined maximum output power level (i.e., the sum of the respective maximum output power levels of the gas burners), or in some embodiments, a combined output power level that is maintained at or below the maximum output power level of one of the gas burners (e.g., the gas burner having the highest maximum output power level).

Figure 14A:
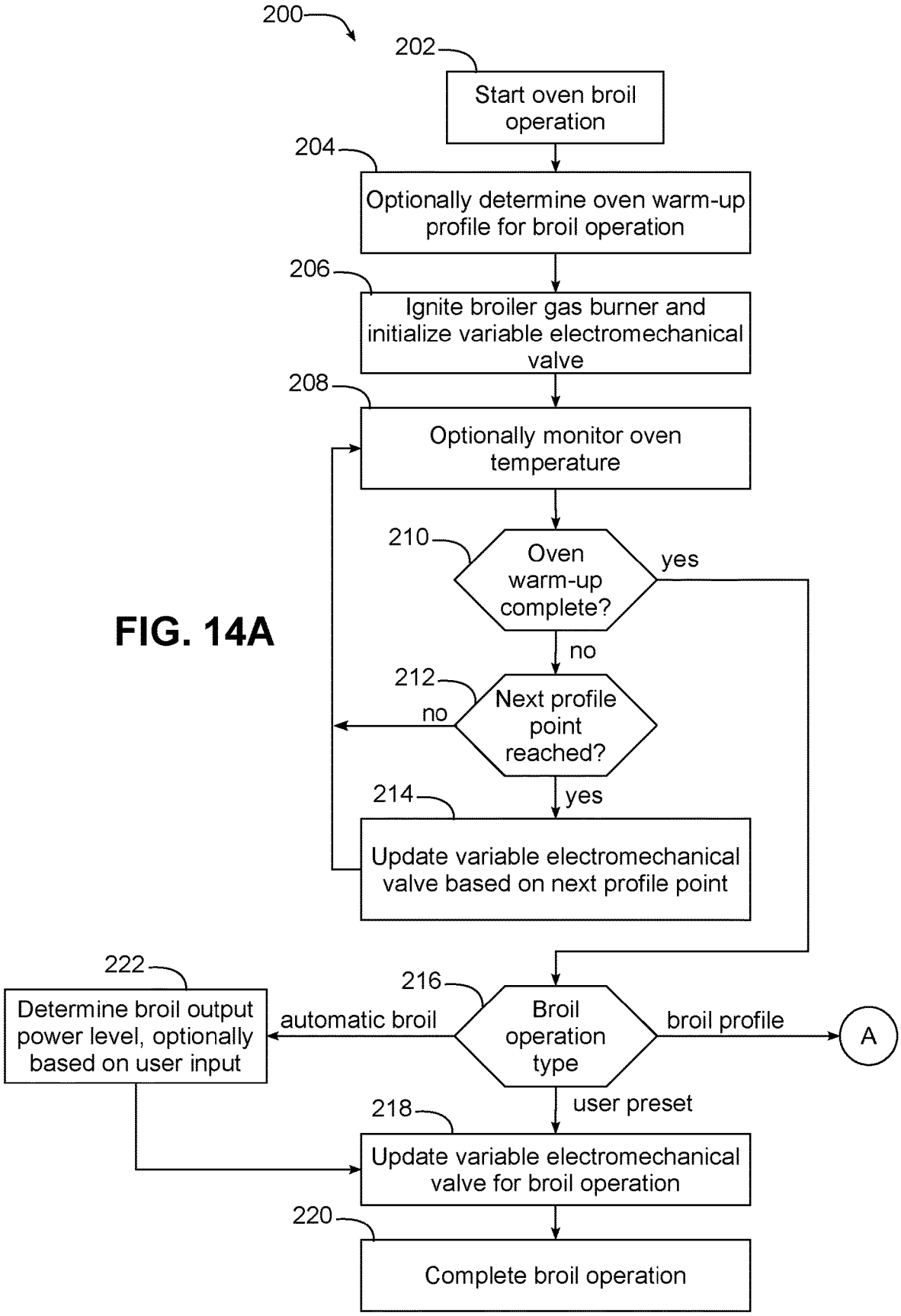
FIGS. 14A-14B are flowcharts illustrating an example sequence of operations for performing an oven broil operation consistent with some embodiments of the invention.
Figure 14B:
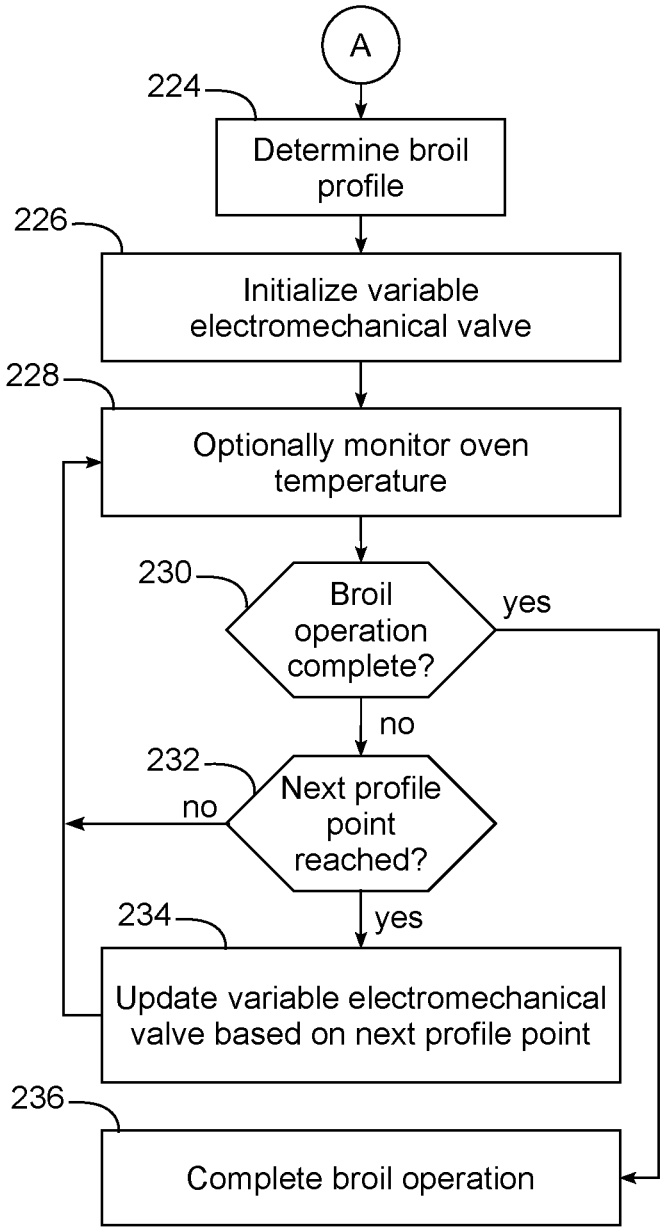

Now turning to FIGS. 14A-14B, these figures illustrate at 200 an example sequence of operations for performing a broil operation in a gas oven consistent with some embodiments of the invention, and implemented, for example, in controller 128 of cooking appliance 100 of FIG. 3. The sequence begins in block 202 by starting the oven broil operation, e.g., in response to user selection of a cooking cycle that utilizes the broiler gas burner and selection of a "start" command through a user interface, and optionally including additional inputs such as a temperature and/or duration, a selection of a cycle type such as broiler, and/or other optional configuration-related inputs as will be discussed in greater detail below.

Next, in block 204, an oven warm-up profile may then be optionally determined. In some embodiments, the over warm-up profile may be hard coded into the cooking appliance, and may thus be static in nature. In other embodiments, however, the warm-up profile may vary depending on different factors such as any setpoint temperature, the current temperature in the oven cavity or the duration since the last cooking operation was complete (both of which are indicative of an oven cavity that is already warm or hot), etc. In other embodiments, however, no warm-up profile may be used, and a conventional profile that simply operates the broiler gas burner at maximum output power level may be used.

Next, in block 206, the gas burner(s) associated with the broil operation (i.e., the broiler gas burner and, if also used, the bake gas burner) is/are ignited and the multi-level valve system(s) therefor is/are initialized to set the output power level(s) of the gas burner(s) based on the determined oven warm-up profile. Then, in block 208, the oven temperature is optionally monitored, and block 210 determines if the oven warm-up is complete. The determination in block 210 in some embodiments may be based upon reaching a setpoint temperature, or alternatively, based upon a static or dynamically-determined duration. If not complete, block 212 determines whether the next profile point, during which a transition to a new output power level is required, has been reached. The determination in block 212 may be time based in some embodiments, while in other embodiments, the determination may be based on other factors, e.g., oven temperature, or even CO levels measured from a CO sensor. If no transition is needed, control returns to block 208 to continue with the oven warm-up operation. If, however, a transition is needed, block 212 passes control to block 214 to update the multi-level valve system to update the gas burner output power level according to the next profile point, and control returns to block 208 to continue with the oven warm-up operation. As such, the oven warm-up operation continues according to the determined profile until the end of the oven warm-up operation is determined to be reached in block 210. It will also be appreciated that if no warm-up profile is used, blocks 212 and 214 may be omitted.

Thereafter, control passes to block 216 to proceed to the broil operation itself. Three different variations on a broil operation are illustrated in sequence 200, although it will be appreciated that in different embodiments, a cooking appliance may only support a subset (e.g., only one) of these variations.

In particular, block 216 selects from among three different broil operation types, a user preset type, an automatic broil type, and a broil profile type. The user preset type causes control to pass to block 218, where the variable electromechanical valve used to control the broiler gas burner is transitioned to a state that provides a user-selected output power level for the broiler gas burner. The user selection may be made via a dedicated control (e.g., a variable control such as a control knob on a control panel) in some embodiments, while in other embodiments the user selection may be made via other user controls such as via a touchscreen. Thus, with this broil operation type, the output power level of the broiler gas burner during the broil operation is effectively decoupled from the output power level(s) used during the warm-up operation. Control then passes to block 220 to complete the broil operation, and it will be appreciated that in some embodiments, the user may be permitted to adjust the output power level of the broiler gas burner at any point during the subsequent broil operation. Further, during this time, the output power level of the broiler gas burner may be varied by the multi-level valve system and/or the broiler gas burner may be cycled on or off, e.g., to maintain a desired temperature setpoint in the oven cavity during the cooking operation.

Returning to block 216, the automatic broil type causes control to pass to block 222 to automatically determine the output power level for the broiler gas burner, optionally based at least in part on user input. As noted above, for example, various factors such as the type of food being cooked, the temperature of the food being cooked, the rack position of the food being cooked, the type and/or size of pan housing the food being cooked, and/or the desired heat intensity to be applied to the food being cooked, may be used to determine the output power level, and any of these factors may be sensed or determined in response to user input.

Once the broil output power level is determined, control then passes to block 218 to update the variable electromechanical valve for the broil operation using the determined broil output power level, and then to block 220 to complete the broil operation accordingly.

Returning again to block 216, the broil profile type causes control to pass to block 224 (FIG. 14B) to implement a multi-level broil profile for the broil operation. In block 224, in particular, a broil profile may be determined, e.g., selected by a user based upon one or more of the aforementioned factors, selected by a user as a profile or recipe, or in other suitable manners, selected in response to sensed conditions in the oven cavity, etc.

Once the broil profile is determined, control passes to block 226 to initialize the variable electromechanical valve for the broiler gas burner to configure the gas burner to output at the initial output power level for the broil profile. Block 228 then optionally monitors the oven temperature, and block 230 determines if the broil operation is complete. The determination in block 230 in some embodiments may be based upon a static or dynamically-determined duration in different embodiments. If not complete, block 232 determines whether the next profile point, during which a transition to a new output power level is required, has been reached. The determination in block 232 may be time based in some embodiments, while in other embodiments, the determination may be based on other factors, e.g., oven temperature, or even CO levels measured from a CO sensor. If no transition is needed, control returns to block 228 to continue with the broil operation. If, however, a transition is needed, block 232 passes control to block 234 to update the variable electromechanical valve to update the broiler gas burner output power level according to the next profile point, and control returns to block 228 to continue with the broil operation. As such, the broil operation continues according to the determined profile until the end of the broil operation is determined to be reached in block 230. Thereafter, control passes to block 236 to complete the broil operation.

It will be appreciated that various modifications may be made to the embodiments discussed herein, and that a number of the concepts disclosed herein may be used in combination with one another or may be used separately. Therefore, the invention lies in the claims hereinafter appended.

What is claimed is:

1. A cooking appliance, comprising:

a housing including an oven cavity;

a broiler gas burner positioned proximate a top of the oven cavity to generate heat within the oven cavity and to radiate heat downward onto food within the oven cavity to sear or brown the food;

a bake gas burner positioned proximate a bottom of the oven cavity to generate heat within the oven cavity;

a variable electromechanical valve configured to couple the broiler gas burner to a gas supply and to regulate an output power level of the broiler gas burner within a range of output power levels that are reduced relative to a maximum output power level of the broiler gas burner and that are at least at a minimum active output power level that is sufficient to maintain an active flame with the broiler gas burner;

a shut off valve of the cooking appliance and coupled in series with the variable electromechanical valve between the broiler gas burner and the gas supply; and a controller in communication with the variable electromechanical valve and the shut off valve, the controller configured to, during a broil operation, control the shut off valve and the variable electromechanical valve to operate the broiler gas burner at a plurality of different reduced output power levels within the range of output power levels for at least a portion of the broil operation to vary the radiation of heat downward onto the food by the broiler gas burner;

wherein the reduced output power level is a first reduced output power level, and wherein the controller is further configured to perform a cooking operation using the bake gas burner and to control the variable electromechanical valve during the cooking operation to cycle the broiler gas burner at a second reduced output power level during the cooking operation.

2. The cooking appliance of claim 1, wherein the controller is configured to control the variable electromechanical valve to operate between fully open and fully closed states, wherein the fully open state causes the broiler gas burner to operate at the maximum output power level.

3. The cooking appliance of claim 1, wherein the variable electromechanical valve comprises a voice coil controlled modulating valve, a stepper motor controlled modulating valve, or an electronically-actuated plug type valve.

4. The cooking appliance of claim 1, wherein the controller is further configured to perform an oven warm-up operation in association with performing the broil operation to warm-up the oven cavity, and wherein the controller is configured to control the variable electromechanical valve to operate the broiler gas burner at a third reduced output power level within the range of output power levels for at least a portion of the warm-up operation.

5. The cooking appliance of claim 4, wherein the controller is further configured to control the variable electromechanical valve to automatically change the output power level for the broiler gas burner to a user-selected preset upon completion of the oven warm-up operation.

6. The cooking appliance of claim 4, wherein the controller is further configured to adjust the output power level for the broiler gas burner in response to user input received after completion of the oven warm-up operation.

7. The cooking appliance of claim 4, wherein the controller is configured to control the variable electromechanical valve to operate the broiler gas burner at the third reduced output power level for at least the portion of the oven warm-up operation by:

controlling the variable electromechanical valve to operate the broiler gas burner at a fourth output power level during a first portion of the oven warm-up operation;

controlling the variable electromechanical valve to operate the broiler gas burner at a fifth output power level that is lower than the fourth output power level during a second portion of the oven warm-up operation that is after the first portion; and controlling the variable electromechanical valve to operate the broiler gas burner at a sixth output power level that is higher than the fifth output power level during a third portion of the oven warm-up operation that is after the second portion.

8. The cooking appliance of claim 1, wherein the controller is configured to determine the first reduced output power level in response to a user-selected preset.

9. The cooking appliance of claim 8, wherein the user-selected setting is received through a variable control on a control panel of the cooking appliance.

10. The cooking appliance of claim 1, wherein the controller is configured to automatically determine the first reduced output power level.

11. The cooking appliance of claim 10, wherein the controller is configured to automatically determine the first reduced output power level in response to user input.

12. The cooking appliance of claim 11, wherein the user input specifies one or more of a type of food being cooked, a temperature of food being cooked, a rack position of food being cooked, a type of pan housing food being cooked, a size of pan housing food being cooked, or a heat intensity to be applied to food being cooked.

13. The cooking appliance of claim 10, wherein the controller is configured to automatically determine the first reduced output power level based on one or more of a type of food being cooked, a temperature of food being cooked, a rack position of food being cooked, a type of pan housing food being cooked, a size of pan housing food being cooked, or a heat intensity to be applied to food being cooked.

14. The cooking appliance of claim 1, wherein the controller is configured to control the variable electromechanical valve to operate the broiler gas burner at a plurality of output power levels within the range of output power levels based upon a multi-level broil profile.

15. The cooking appliance of claim 14, wherein the controller is configured to transition between the plurality of output power levels based on time or temperature within the oven cavity.

16. The cooking appliance of claim 1, wherein the variable electromechanical valve is a first variable electromechanical valve, wherein the cooking appliance further comprises a second variable electromechanical valve configured to couple the bake gas burner to the gas supply and to regulate an output power level of the bake gas burner within a range of output power levels that are reduced relative to a maximum output power level of the bake gas burner, and wherein the controller is configured to control the second variable electromechanical valve during the cooking operation to regulate a temperature in the oven cavity during the cooking operation.

17. The cooking appliance of claim 1, wherein the variable electromechanical valve is a first variable electromechanical valve, wherein the cooking appliance further comprises a second variable electromechanical valve configured to couple the bake gas burner to the gas supply and to regulate an output power level of the bake gas burner within a range of output power levels that are reduced relative to a maximum output power level of the bake gas burner and that are at least at a minimum active output power level that is sufficient to maintain an active flame with the bake gas burner, wherein the controller is configured to control each of the first and second variable electromechanical valves to maintain a combined output power level of the broiler gas burner and the bake gas burner when the broiler gas burner and the bake gas burner are simultaneously active at or below about half of a combined maximum output power level for the broiler gas burner and the bake gas burner and thereby inhibit an increase of a carbon monoxide level within the oven cavity when the broiler gas burner and the bake gas burner are simultaneously active, and wherein the controller is further configured to control the first electromechanical valve to regulate the output power level of the broiler gas burner above the about half of the combined maximum output power level for the broiler gas burner and the bake gas burner when the bake gas burner is inactive.

18. A cooking appliance, comprising:

a housing including an oven cavity;

a broiler gas burner positioned proximate a top of the oven cavity to generate heat within the oven cavity;

a bake gas burner positioned proximate a bottom of the oven cavity to generate heat within the oven cavity;

a first variable electromechanical valve configured to couple the broiler gas burner to a gas supply and to regulate an output power level of the broiler gas burner within a first range of output power levels that are reduced relative to a maximum output power level of the broiler gas burner and that are at least at a minimum active output power level that is sufficient to maintain an active flame with the broiler gas burner;

a second variable electromechanical valve configured to couple the bake gas burner to the gas supply and to regulate an output power level of the bake gas burner within a second range of output power levels that are reduced relative to a maximum output power level of the bake gas burner and that are at least at a minimum active output power level that is sufficient to maintain an active flame with the bake gas burner;

a shut off valve of the cooking appliance and coupled in series with the first variable electromechanical valve between the broiler gas burner and the gas supply; and a controller in communication with the first and second variable electromechanical valves and the shut off valve, the controller configured to, during a cooking operation, control the shut off valve and the first and second variable electromechanical valves to operate the broiler gas burner and the bake gas burner at respective reduced output power levels within the respective first and second ranges of output power levels for at least a portion of the cooking operation, and wherein the controller is configured to control each of the first and second variable electromechanical valves to maintain a combined output power level of the broiler gas burner and the bake gas burner when the broiler gas burner and the bake gas burner are simultaneously active at or below about half of a combined maximum output power level for the broiler gas burner and the bake gas burner and/or at or below a maximum output power level for one of the broiler gas burner and the bake gas burner and thereby inhibit an increase of a carbon monoxide level within the oven cavity.

19. A cooking appliance, comprising:

a housing including an oven cavity;

a broiler gas burner positioned proximate a top of the oven cavity to generate heat within the oven cavity and to radiate heat downward onto food within the oven cavity to sear or brown the food;

a bake gas burner positioned proximate a bottom of the oven cavity to generate heat within the oven cavity;

a variable electromechanical valve configured to couple the broiler gas burner to a gas supply and to regulate an output power level of the broiler gas burner within a range of output power levels that are reduced relative to a maximum output power level of the broiler gas burner and that are at least at a minimum active output power level that is sufficient to maintain an active flame with the broiler gas burner;

a shut off valve of the cooking appliance and coupled in series with the variable electromechanical valve between the broiler gas burner and the gas supply; and a controller in communication with the variable electromechanical valve and the shut off valve, the controller configured to, during a broil operation, control the shut off valve and the variable electromechanical valve to operate the broiler gas burner at a plurality of different reduced output power levels within the range of output power levels for at least a portion of the broil operation to vary the radiation of heat downward onto the food by the broiler gas burner;

wherein the variable electromechanical valve is a first variable electromechanical valve, wherein the cooking appliance further comprises a second variable electromechanical valve configured to couple the bake gas burner to the gas supply and to regulate an output power level of the bake gas burner within a range of output power levels that are reduced relative to a maximum output power level of the bake gas burner and that are at least at a minimum active output power level that is sufficient to maintain an active flame with the bake gas burner, wherein one of the broiler gas burner and the bake gas burner has a higher maximum output power level than the other of the broiler gas burner and the bake gas burner, wherein the controller is configured to control each of the first and second variable electromechanical valves to maintain a combined output power level of the broiler gas burner and the bake gas burner when the broiler gas burner and the bake gas burner are simultaneously active at or below the maximum output power level for the one of the broiler gas burner and the bake gas burner having the higher maximum output power level and thereby inhibit an increase of a carbon monoxide level within the oven cavity when the broiler gas burner and the bake gas burner are simultaneously active, and wherein the controller is further configured to control the one of the first and second variable electromechanical valve for the one of the broiler gas burner and the bake gas burner having the higher maximum output power level to regulate the output power level of the one of the broiler gas burner and the bake gas burner having the higher maximum output power level to operate at the maximum output power level thereof when the one of the broiler gas burner and the bake gas burner having the lower maximum output power level is inactive.

* * * * *